US011021896B2

(12) United States Patent
Ichinose

(10) Patent No.: US 11,021,896 B2
(45) Date of Patent: Jun. 1, 2021

(54) MOTOR VEHICLE DOOR LOCK DEVICE

(71) Applicant: MITSUI KINZOKU ACT CORPORATION, Kanagawa (JP)

(72) Inventor: Mikio Ichinose, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 664 days.

(21) Appl. No.: 15/569,408

(22) PCT Filed: Apr. 28, 2015

(86) PCT No.: PCT/JP2015/062902
§ 371 (c)(1),
(2) Date: Oct. 26, 2017

(87) PCT Pub. No.: WO2016/174753
PCT Pub. Date: Nov. 3, 2016

(65) Prior Publication Data

US 2018/0080264 A1 Mar. 22, 2018

(51) Int. Cl.
*E05B 81/06* (2014.01)
*E05B 81/76* (2014.01)
(Continued)

(52) U.S. Cl.
CPC ..... *E05B 81/56* (2013.01); *E05B 77/265* (2013.01); *E05B 77/54* (2013.01); *E05B 81/16* (2013.01);
(Continued)

(58) Field of Classification Search
CPC ... Y10T 292/1082; E05B 81/16; E05B 81/56; E05B 81/76
See application file for complete search history.

(56) References Cited

U.S. PATENT DOCUMENTS 6,386,599 B1 * 5/2002 Chevalier ..... E05B 81/14 292/201
6,698,805 B2 * 3/2004 Erices ..... E05B 77/04 292/201
(Continued)

FOREIGN PATENT DOCUMENTS

JP 3-12192 2/1991
JP 08218710 A * 8/1996
(Continued)

OTHER PUBLICATIONS

International Search Report, PCT/JP2015/062902, dated Jul. 28, 2015.

*Primary Examiner* — Carlos Lugo
(74) *Attorney, Agent, or Firm* — Nixon & Vanderhye

(57) ABSTRACT

A motor vehicle door lock device includes an engagement mechanism that engages with a striker to hold the door closed; a positioned outside a vehicle; a locking mechanism that turns an unlock state for enabling the engagement mechanism to be released based on a door-opening action of the outside handle with a locking motor as a drive source and a lock state for making releasing impossible, a control that enables an operation of the switches when an external transmitter is authenticated and cancels it when it is not authenticated; and an electric release mechanism that can release the engagement mechanism regardless of a state of the locking mechanism by releasing a releasing motor as a drive source.

18 Claims, 16 Drawing Sheets

(51) Int. Cl.

| | |
|---|---|
| ***E05B 81/56*** | (2014.01) |
| ***E05B 81/16*** | (2014.01) |
| ***E05B 77/26*** | (2014.01) |
| ***E05B 77/54*** | (2014.01) |
| *E05B 81/14* | (2014.01) |
| *E05B 77/30* | (2014.01) |

(52) U.S. Cl.
CPC ..... *E05B 81/76* (2013.01); *E05B 77/30* (2013.01); *E05B 81/06* (2013.01); *E05B 81/14* (2013.01); *Y10T 292/1082* (2015.04)

(56) References Cited

U.S. PATENT DOCUMENTS 6,825,752 B2 * 11/2004 Nahata ..... E05B 81/78 180/273
7,091,836 B2 * 8/2006 Kachouh ..... E05B 81/78 340/426.28
7,446,645 B2 * 11/2008 Steegmann ..... B60R 25/246 340/5.6
7,518,381 B2 * 4/2009 Lamborghini ..... B60K 37/06 324/679
7,926,857 B2 * 4/2011 Akizuki ..... E05B 77/26 292/201
8,025,320 B2 * 9/2011 Inoue ..... E05B 81/20 292/201
8,146,965 B2 * 4/2012 Akizuki ..... E05B 81/06 292/201
8,151,610 B2 * 4/2012 Fujihara ..... E05B 77/283 292/201
8,267,444 B2 * 9/2012 Akizuki ..... E05B 77/26 292/201
8,451,087 B2 * 5/2013 Krishnan ..... B60J 5/04 340/5.72
8,474,888 B2 * 7/2013 Tomaszewski ..... E05B 77/26 292/201
8,740,264 B2 * 6/2014 Akizuki ..... E05B 77/265 292/201
9,903,142 B2 * 2/2018 Van Wiemeersch .... E05B 77/54
2003/0101781 A1 * 6/2003 Budzynski ..... E05B 85/10 70/239
2003/0107473 A1 * 6/2003 Pang ..... H03K 17/962 340/5.72
2006/0125245 A1 * 6/2006 Graute ..... E05B 81/14 292/216
2008/0068129 A1 * 3/2008 Ieda ..... E05B 85/16 340/5.72
2010/0237635 A1 * 9/2010 Ieda ..... G07C 9/00309 292/336.3
2010/0315267 A1 * 12/2010 Chung ..... H03K 17/9622 341/22
2013/0104459 A1 * 5/2013 Patel ..... E05B 81/90 49/70
2014/0069015 A1 * 3/2014 Salter ..... E05B 81/76 49/31
2014/0110952 A1 * 4/2014 Lange ..... E05B 81/06 292/129
2015/0330113 A1 * 11/2015 Van Wiemeersch .... H04W 4/14 292/336.3
2016/0076277 A1 * 3/2016 Kouzuma ..... E05B 41/00 292/201
2018/0038137 A1 2/2018 Damboiu et al.

FOREIGN PATENT DOCUMENTS

JP 4145774 9/2008
JP 4617588 1/2011
WO 2016/132464 A1 8/2016

* cited by examiner

FIG. 16

○ ENABLE
× CANCEL (FRONT DOOR FD)

| | | | | | | | | | | | |
|---|---|---|---|---|---|---|---|---|---|---|---|
| PORTABLE SWITCH SW10 | ○ | ○ | × | × | × | × | ○ | ○ | ○ | ○ | × |
| EXTERNAL SWITCH (DOOR AT DRIVER'S SEAT) | ○ | ○ | × | × | × | × | ○ | × | ○ | × | × |
| EXTERNAL SWITCH (DOOR AT PASSENGER SEAT) | ○ | ○ | × | × | × | × | ○ | × | ○ | × | × |
| INTERNAL SWITCH (DOOR AT DRIVER'S SEAT) | ○ | ○ | × | ○ | × | × | ○ | ○ | ○ | × | × |
| INTERNAL SWITCH (DOOR AT PASSENGER SEAT) | ○ | × | × | ○ | × | × | ○ | ○ | × | × | × |
| TRANSMITTER SW6 | AUTHENTICATED (OUTSIDE) | | | UNAUTHENTICATED | | | AUTHENTICATED(INSIDE) | | | | |
| CANCELLING SWITCH SW5 | UNSET | CANCEL | UNSET/ CANCEL | UNSET | CANCEL | UNSET/ CANCEL | UNSET | | CANCEL | | UNSET/ CANCEL |
| LOCKING-STATE DETECTING SWITCH SW7 | UNLOCK/LOCK | | | UNLOCK/LOCK | | | UNLOCK | LOCK | UNLOCK | LOCK | UNLOCK /LOCK |
| VEHICLE SPEED SENSOR SW9 | STOP | | RUN | STOP | | RUN | STOP | | | | RUN |

FIG.17

○ ENABLE
× CANCEL (REAR DOOR RD)

| | | | | | | | | | | | | | | | |
|---|---|---|---|---|---|---|---|---|---|---|---|---|---|---|---|
| PORTABLE SWITCH SW10 | ○ | ○ | ○ | × | × | × | × | × | ○ | ○ | ○ | ○ | ○ | ○ | × |
| EXTERNAL SWITCH SW3 | ○ | ○ | ○ | × | × | × | × | × | ○ | × | ○ | × | ○ | × | × |
| INTERNAL SWITCH SW4 | ○ | × | × | × | ○ | × | × | × | ○ | ○ | × | × | × | × | × |
| TRANSMITTER SW6 | AUTHENTICATED (OUTSIDE) | | | | UNAUTHENTICATED | | | | AUTHENTICATED(INSIDE) | | | | | | |
| CANCELLING SWITCH SW5 | UNSET | | CANCEL | UNSET/ CANCEL | UNSET | | CANCEL | UNSET/ CANCEL | UNSET | | | | CANCEL | | UNSET/ CANCEL |
| LOCKING-STATE DETECTING SWITCH SW7 | UNLOCK/LOCK | | | | UNLOCK/LOCK | | | | UNLOCK | LOCK | UNLOCK | LOCK | UNLOCK | LOCK | UNLOCK /LOCK |
| CHILDPROOF STATE DETECTING SWITCH SW8 | UNLOCK | LOCK | UNLOCK/LOCK | | UNLOCK | LOCK | UNLOCK/LOCK | | UNLOCK | | LOCK | | UNLOCK/LOCK | | |
| VEHICLE SPEED SENSOR SW9 | STOP | | | RUN | STOP | | | RUN | STOP | | | | | | RUN |

MOTOR VEHICLE DOOR LOCK DEVICE

BACKGROUND OF THE INVENTION

The present invention relates to a motor vehicle door lock device.

JP4145774B discloses a motor vehicle door lock device in which a door can be opened with a releasing motor on the basis of an external electric element (switch) on the door outside a vehicle when an ID signal is authenticated through a wireless communication between a transmitter carried by a driver and an authenticating portion in the vehicle, while the door cannot be opened by cancelling the external electric element when the ID signal is not authenticated.

JP4617588B discloses a motor vehicle door lock device in which a door can be opened with a releasing motor on the basis of an external electric element (opening switch) on the side of the door outside the vehicle when a control device controls an unlock state electrically, while the door cannot be opened with the external electric element by cancelling the external electric elements when the control device controls a lock state electrically.

In the motor vehicle door lock device in JP4145774B, not only a driver but also a passenger can open the door with a single operation of the external electric element when the ID signal is authenticated, but the passenger without a transmitter cannot open the door when the ID signal is not authenticated. So it is not convenient for the passenger.

In the motor vehicle door lock device in JP4617588B, when the control device controls the unlock state, a passenger without a transmitter can open the door by operating the external electric element, but in order to open the locked door from an outside of the vehicle, even a driver with the transmitter requires two operations, i.e. an unlocking action for turning the lock state to the unlock state and a door-opening action of the external electric element. Thus, the door cannot be opened swiftly, and it is not convenient for the driver.

SUMMARY OF THE INVENTION

In view of the disadvantages, it is an object of the invention to provide a motor vehicle door lock device that is more convenient when a driver or a passenger opens a door.

BRIEF DESCRIPTION OF THE DRAWINGS

FIG. 16 is a table showing a relation between electrically-operating elements of the front door and switches.

FIG. 17 is a table showing a relation between the electrically-operating elements of the rear door and the switches.

DETAILED DESCRIPTION OF PREFERRED EMBODIMENT

One embodiment of the invention will be described with respect to drawings.

Figure 1:
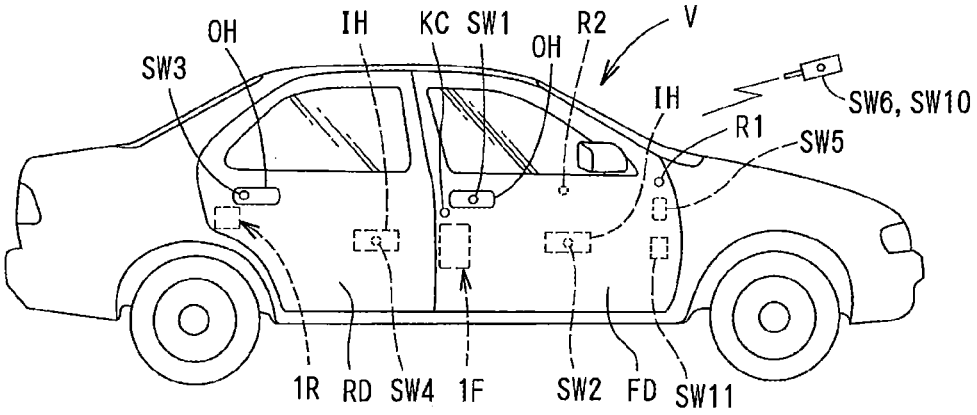
FIG. 1 is a side elevational view of a motor vehicle with a door lock device according to the present invention.

In FIG. 1, a front door FD of a four-door motor vehicle V comprises a door lock device 1F for the front door to hold the front door FD closed; an outside handle OH as an external mechanically-operating element outside the vehicle; an external switch SW1 as an external electrically operating element outside the vehicle; an inside handle IH as an internal mechanically-operating element inside the vehicle; an internal switch SW2 as an internal electrically operating element inside the vehicle; a key cylinder KC for switching a locking device (later described) of a door lock device 1F from the outside of the vehicle to a lock state and an unlock state; and a locking knob (not shown) for switching a locking mechanism to a lock state and an unlock state from the inside of the vehicle.

A rear door RD comprises a door lock device 1R for holding the rear door RD closed; an outside handle OH as an external mechanically-operating element outside the vehicle; an external switch SW3 as an external electrically operating element outside the vehicle, an inside handle IH as an internal mechanically operating element inside the vehicle; an internal switch SW4 as an internal electrically operating element inside the vehicle; and a locking knob (not shown) for switching a locking mechanism of a door lock device 1R from the inside of the vehicle to a lock state and an unlock state. The locking knobs of the front door FD and the rear door RD may be left out depending on a design.

In an area where a driver can operate at a driver's seat (such as an interior close to the driver's seat or an inner side of the front door FD), there are disposed an internal switch SW2 for all doors except a door at the driver's seat; a cancelling switch SW5 for enabling or cancelling SW4, and an internal locking switch SW11 for switching the locking mechanisms for all the doors to a lock state or an unlock state together, at the interior of the vehicle.

The external switches SW1, SW3 are disposed at a front surface of, a back surface of or close to each of the outside handles. The internal switches SW2, SW4 are disposed on a front surface of, a back surface of or close to each of the inside handles IH. In this embodiment, each of the switches SW1 to SW4 is a static capacity type touch switch that detects that a finger of a user touches, but is not limited thereto. It may be a proximity switch that detects that part of a human body approaches.

When a regular user (driver) with a transmitter SW6 (or an electronic key) used exclusively for the vehicle approaches a predetermined area around the vehicle V and it is authenticated with agreement in checking of ID signal through wireless communications between the transmitter SW6 and an external receiver R1 at the outer side of a vehicle body that the regular user approaches the vehicle V, the external switches SW1, SW3 are electrically controlled by ECU (Electronic Control Unit) in the vehicle to enable the user to operate.

In the vehicle V, besides the external receiver R1, an internal receiver R2 is disposed inside the vehicle. The external receiver R1 is able to receive a signal from the transmitter SW6 existing within the external predetermined area, and the internal receiver R2 is able to receive a signal from the transmitter SW6 inside the vehicle.

The transmitter SW6 is positioned in a wireless portable switch SW10 as an external electrically-operating element carried by the user, or is separate from the portable switch SW10. The portable switch SW10 comprises an opening-switch portion operated when the door is opened; and a lock/unlock switch portion operated when the locking mechanism is switched. The opening-switch portion is assigned for each of the doors, and the lock/unlock switch portion is used for all the doors. When the ID signal from transmitter SW6 is authenticated, the open-switch portion and the lock/unlock switch portion can be operated, and when it is not authenticated, they cannot be operated.

Figure 2:
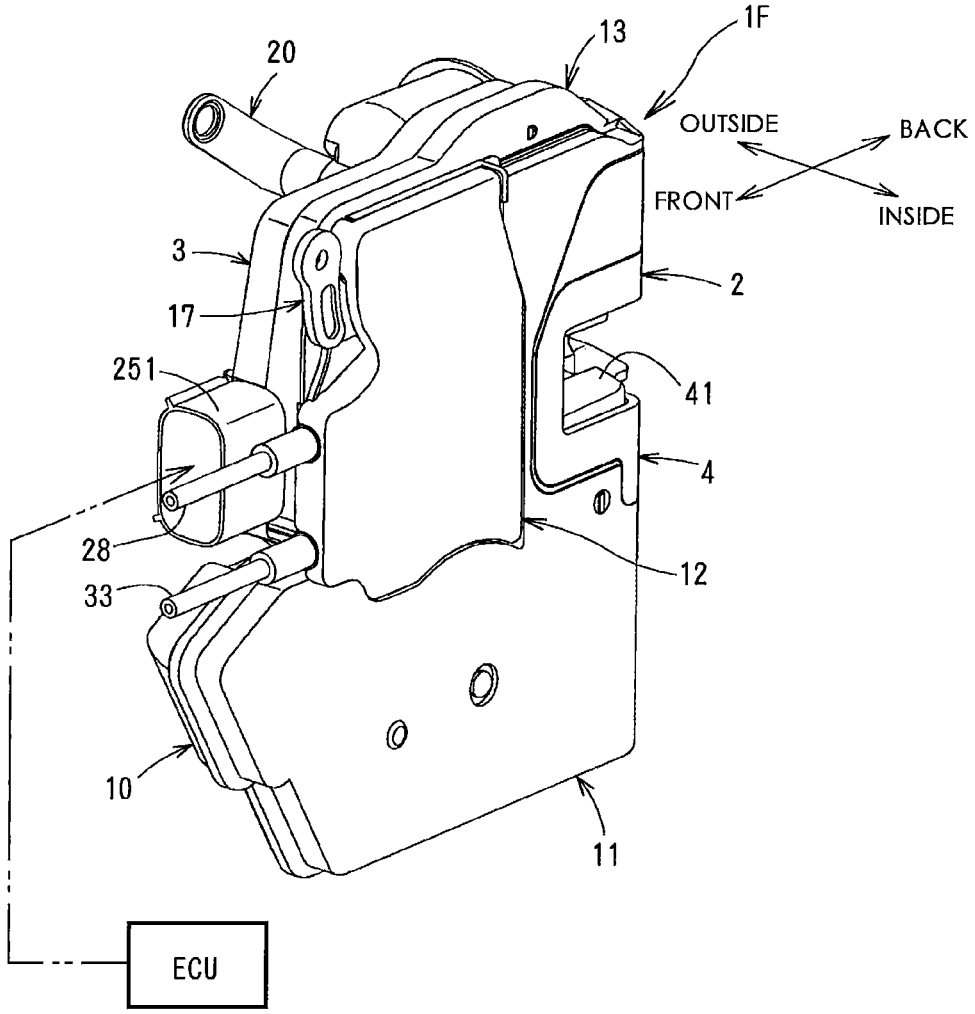
FIG. 2 is a perspective view of the door lock device for a front door.
Figure 3:
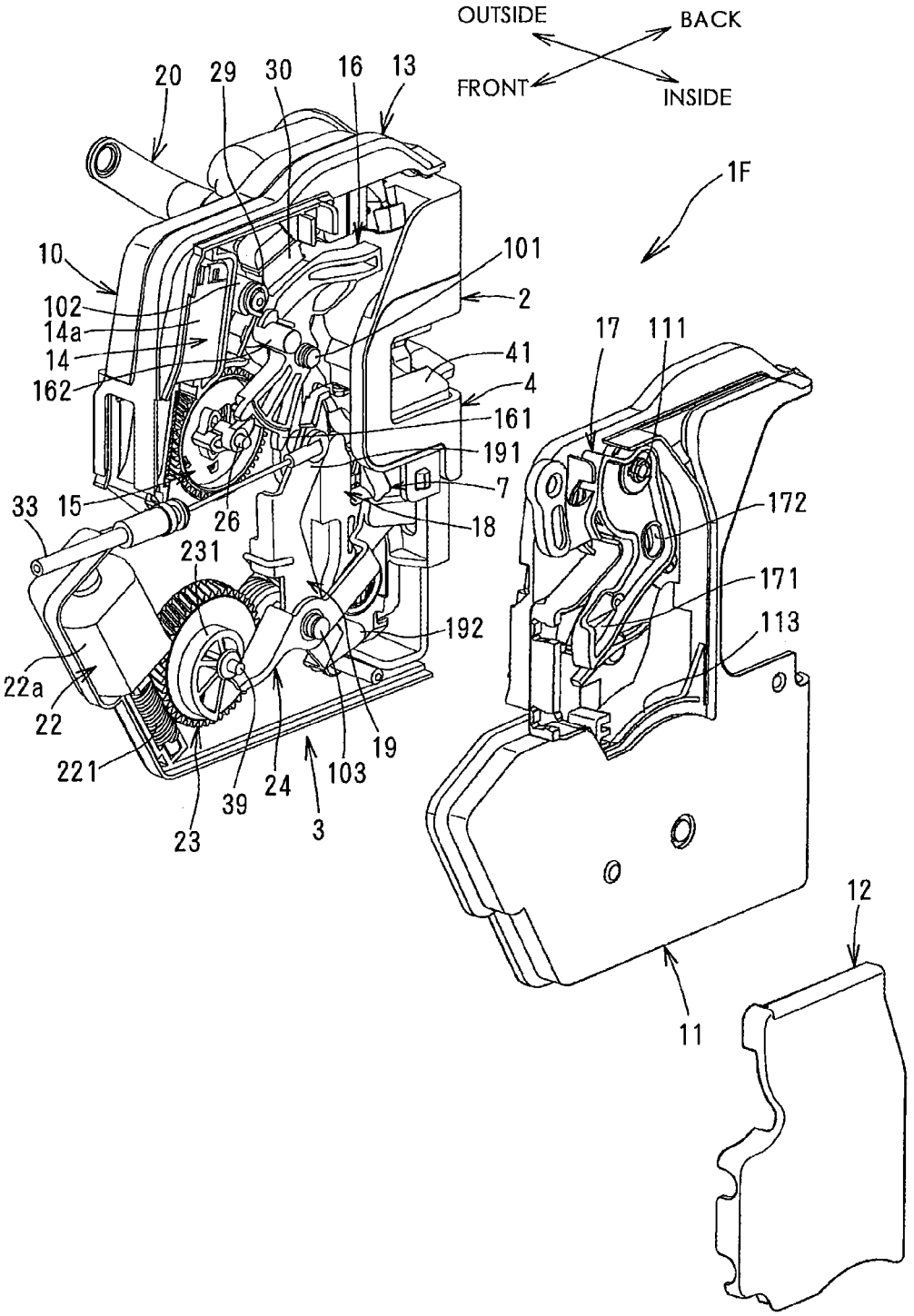
FIG. 3 is a partially exploded perspective view of the door lock device.
Figure 4:
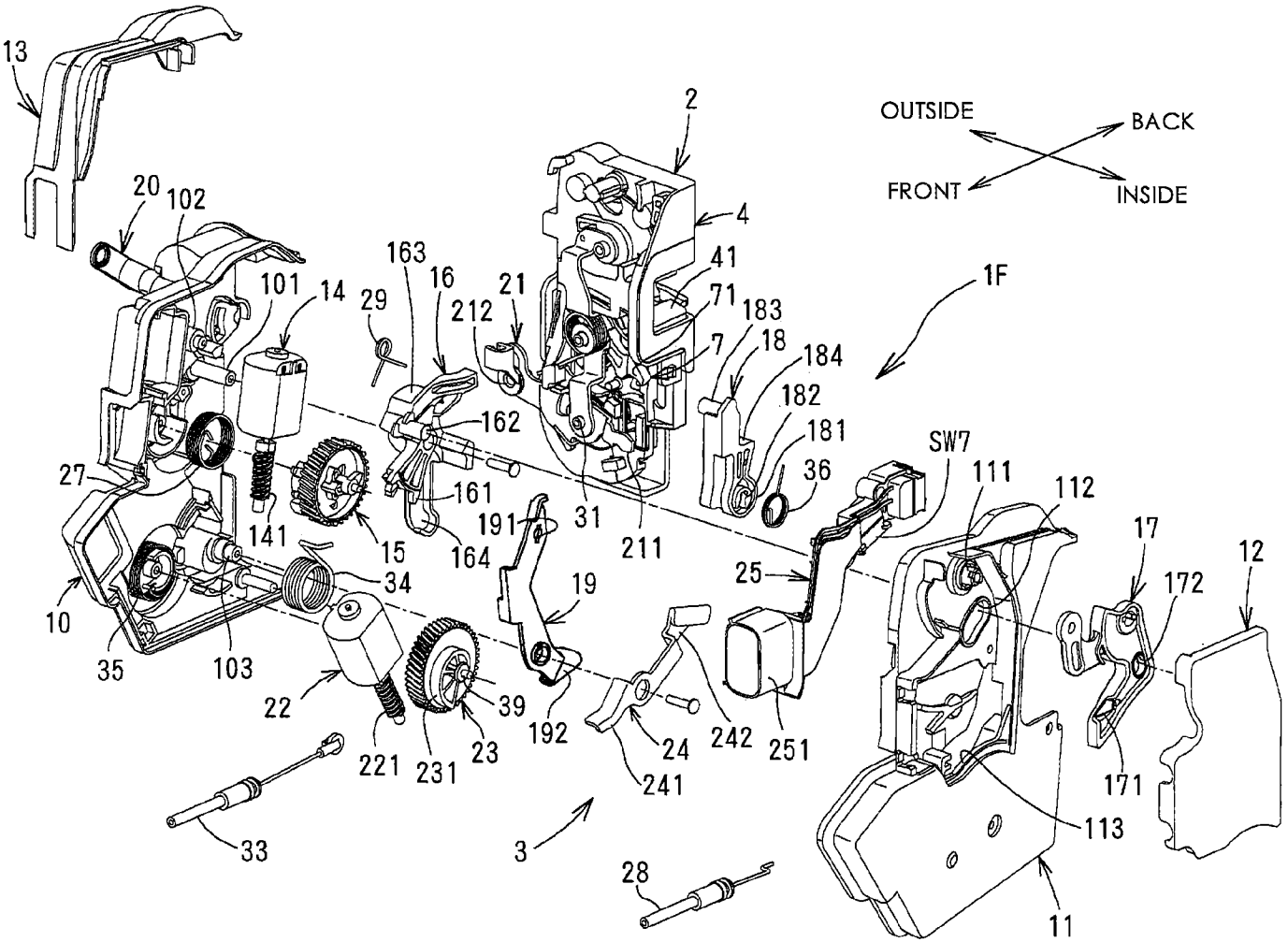
FIG. 4 is an exploded perspective view of the door lock device.
Figure 5:
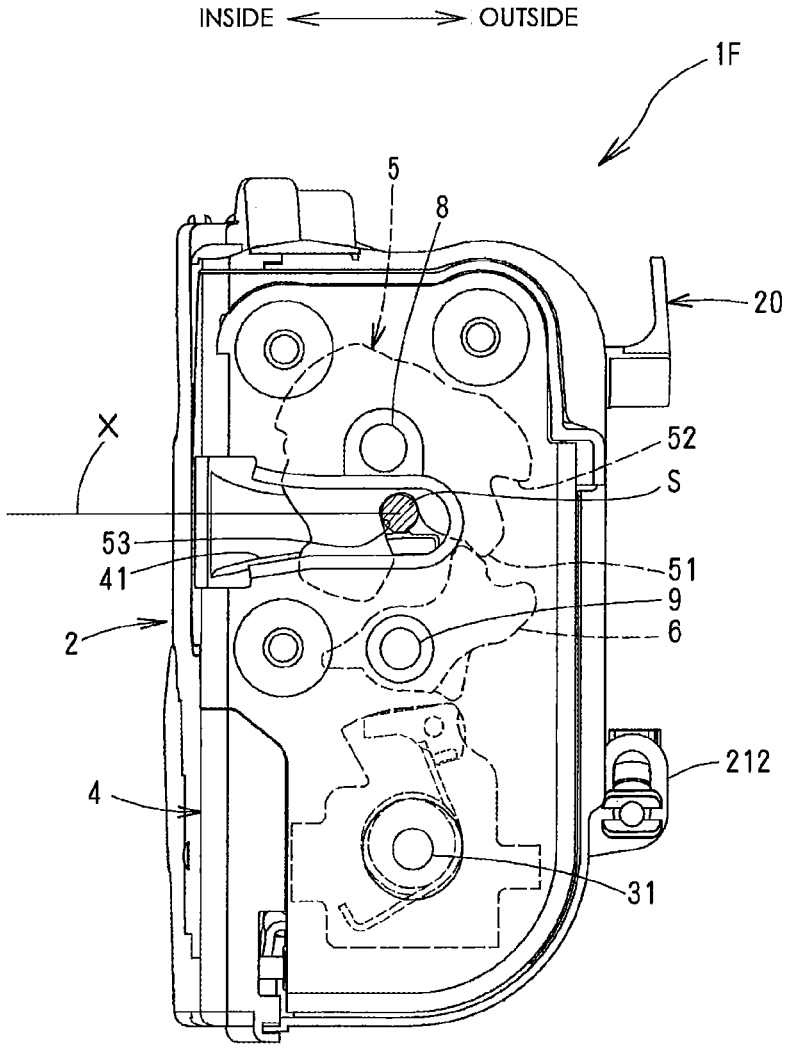
FIG. 5 is a back elevational view of the door lock device.

FIG. 2 is a perspective view of the door lock device 1F; FIG. 3 is a partially-exploded perspective view of the door lock device 1F; FIG. 4 is an exploded perspective view of the door lock device 1F; FIG. 5 is a back elevational view of the door lock device 1F; and FIGS. 6-11 are operation explaining views.

Directions in the following description are determined in the door lock devices 1F, 1R attached in the door.

The door lock device 1F is mounted in the front door FD and comprises an engagement unit 2 that comprises an engagement mechanism that engages with a striker S of the vehicle body to hold the front door FD closed and an operating unit 3 that comprises a locking mechanism that comprises mechanical elements such as a lever and a link with which the front door FD is switched to a lock state or an unlock state.

In FIG. 5, the engagement unit 2 comprises, as main elements, a body 4 fixed at a rear end of the front door FD with a plurality of bolts (not shown); an engagement mechanism (not numbered) housed in the body 4 and including a latch 5 that can engage with a striker S fixed to the vehicle body and a ratchet 6 that can engage with the latch 5; and an opening lever 7 that can release the ratchet 6 from the latch 5 in FIG. 4.

The latch 5 is pivotally mounted in the body 4 via a latch shaft 8 that lies longitudinally of the vehicle, and comprises a full-latch engagement portion 51 and a half-latch engagement portion 52 with which the ratchet 6 can engage; and an engagement groove 53 in which the striker S that enters into a striker-entering groove 41 of the body 4 can engage.

In FIG. 5, the striker-entering groove 41 of the body 4 is a little higher than a vertically middle portion and is open inward of the vehicle to extend outward of the vehicle. A symbol "X" in FIG. 5 stands for a striker-entering line along which the striker S enters the striker-entering groove 41 and engages with the engagement groove 53 of the latch 5 to close the front door FD.

With a closing motion of the front door FD, the latch 5 rotates counterclockwise against a spring (not shown) by a certain angle from an open position (to which the latch 5 rotates from a position in FIG. 5 clockwise) in which it does not engage from the striker S with the front door FD open, to a half-latch position for a slightly-engaging state where the engagement groove 53 slightly engages with the striker S that comes into the striker entering groove 41 along the striker-entering line X from a left in FIG. 5 and to a full-latch position in FIG. 5 for a fully-closed state in which the striker S fully engages with the engagement groove 53. The latch 5 rotate vice versa as the striker S goes out of the striker-entering groove 41 with an opening motion of the front door FD.

The ratchet 6 is pivotally mounted within the body 4 via a ratchet shaft 9 which lies longitudinally of the vehicle below the striker entering groove 41 and is urged by a spring (not shown) in an engaging direction (counterclockwise in FIG. 5 and in a direction for engaging with the full-latch engagement portion 51 or the half-latch engagement portion 52). The ratchet 6 engages with the full-latch engagement portion 51 to hold the front door FD fully closed and engages with the half-latch engagement portion 52 to hold the front door FD not fully closed.

In FIG. 4, the opening lever 7 is pivotally mounted via an axis for the ratchet 6 on a front surface of the body 4 so as to rotate together with the ratchet 6, and is released (or rotated counterclockwise in FIG. 4) to disengage the ratchet 6 from the latch 5. A released portion 71 is formed at an end of the opening lever 7 extending inward of the vehicle.

The operating unit 3 will be described.

In FIG. 4, the operating unit 3 comprises a first L-shaped synthetic-resin cover 10 fixed to the body 4 to cover a front surface of the body 4; a second synthetic-resin cover 11 closing a side of the first cover 10 toward the inside of the vehicle; a synthetic-resin waterproof side cover 12 for closing an upper half of the second cover 11; a waterproof top cover 13 covering an upper joining surface between the first cover 10 and the second cover 11; and an operating mechanism (not numbered) housed inside the housing.

"Inside the housing" in the description means a space formed between a side of the first cover 10 substantially perpendicular to the front surface of the body and a side of the second cover 11 facing the side of the first cover 10.

The operating mechanism comprises a locking motor 14 as a drive source for the locking mechanism; a locking worm wheel 15 reversibly rotated by the locking motor 14; a locking lever 16 that can move between an unlock position for enabling the door to open with the outside handle OH and a lock position for enabling the door not to open; an open link 18 that can move to unlock position and a lock position with the locking lever 16; an inside lever 19 connected to the inside handle IH; a key lever 20 connected to the key cylinder KC; an outside lever 21 connected to the outside handle OH; a releasing motor 22 as a drive source for an electric releasing mechanism; a releasing worm wheel 23 that can be rotated by the releasing motor 22; an electric releasing lever 24 that releases (or rotates counterclockwise in FIG. 6) by rotating the releasing worm wheel 23; and a wiring member 25 with wires electrically connected to the locking motor 14, the releasing motor 22 and the switches. A space between the second cover 11 and the waterproof side cover 12 has a knob lever 17 connected to the manually-operated locking knob on the front door FD inside the vehicle. The knob lever will not be provided if the locking knob is not provided.

The locking mechanism in this embodiment comprises the locking motor 14 as a drive source; the locking worm wheel 15, the locking lever 16 and the open link 18 as mechanical elements.

"The unlock state" in the following description means that the locking lever 16, the knob lever 17 and the open link 18 are in the unlock position respectively, and "the lock state" means that the locking lever 16, and the knob lever 17 and the open link 18 are in the lock position respectively. The locking mechanism is not limited to the present embodiment, but may be modified.

The electric releasing mechanism comprises the releasing motor 22 as the drive source; the releasing worm wheel 23 and the electric releasing lever 24.

The locking motor 14 is housed in the housing, and a case 14*a* (yoke) for the locking motor 14 is above the striker-entering line X in FIG. 5. An output shaft 14*b* pivotally connected to the case 14*a* is directed downward. Thus, rainwater which comes through the striker-entering groove 41 is prevented from flowing into the case 14*a* for the locking motor 14.

The wiring member 25 is integrally formed with a coupler 25 connected to an in-vehicle battery (not shown) and an external connector (not shown) connected to ECU. On a side toward an outside of the vehicle, circuits for supplying power and signals into the housing are made, and the wiring member 25 is fixed in the housing to cover the case 14*a* for the locking motor 14. The circuits on the wiring member 25 are electrically connected to terminals of the locking motor 14 and the releasing motor 22, and to the external connector connected to the coupler 251 so that the locking motor 14 and the releasing motor 22 are controlled by ECU. FIG. 3 clearly shows an internal structure of the operating unit 3 without the wiring member 25.

Figure 6:
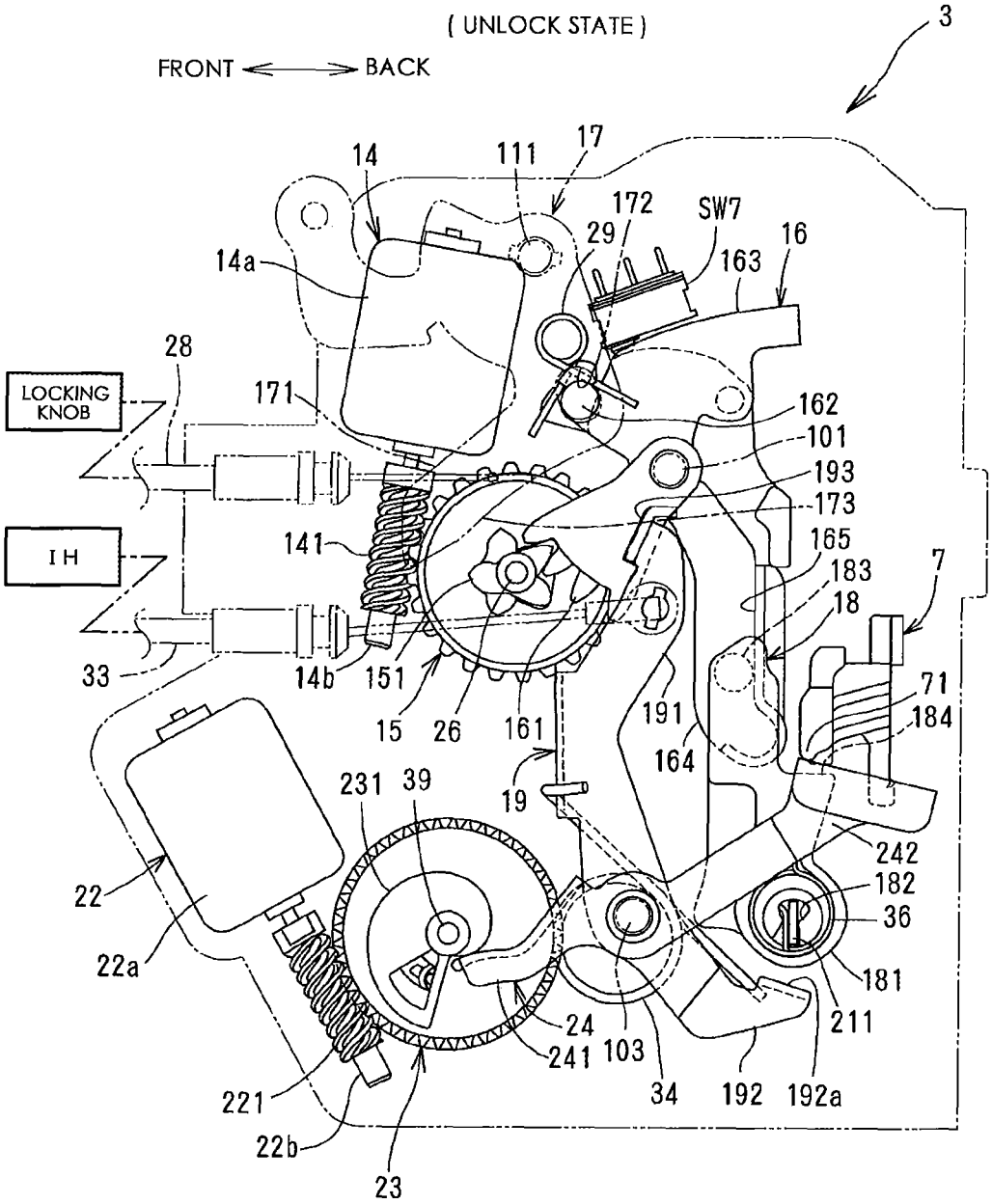
FIG. 6 is a side elevational view of a main part when a locking mechanism of a door lock device is in an unlock state.

In FIG. 6, the locking worm wheel 15 is pivotally mounted in the housing via a shaft 26 below the case 14*a* for the locking motor 14 and meshes with a worm 141 fixed on the output shaft 14*b* of the locking motor 14. Hence, the worm wheel 15 is rotated by the locking motor 14 clockwise or counterclockwise from a neutral position (such as a position in FIG. 6) against the spring 27 (in FIG. 4) wound in the shaft 26. When the locking motor 14 stops, the worm wheel 15 returns to the neutral position again from a position to which it is rotated by the spring 27.

The knob lever 17 is pivotally mounted to a side of the second cover 11 via a shaft 111 of the second cover 11. A connecting arm 171 that extends downward is connected to the manually-operated locking knob via a connecting member 28 that comprises a Bowden cable, and the knob lever 17 is rotated to, for example, an unlock position in FIG. 6 and a lock position in FIG. 7 to which it rotates counterclockwise by a certain angle from the unlock position, by unlocking action or locking action of the locking knob. The action of the locking knob is transmitted to the locking lever 16 and the open link 18 via the knob lever 17 as described later. The connecting member 28 will not be provided if the locking knob is not provided.

A waterproof side cover 12 is fixed to an outer side of the second cover 11 after the knob lever 17 is attached to the second cover 11, thereby closing part of the outer side of the second cover 11 including an area where the knob lever 17 is disposed, and preventing rainwater from coming into the housing.

The locking lever 16 is pivotally mounted in the housing via a shaft 101 provided on an inner side surface and extending inward of the vehicle. Teeth of the locking lever 16 mesh with teeth 151 of the worm wheel 15, and an upper part is coupled to the key lever 20. A connecting projection 162 on a front upper part is coupled in a connecting hole 172 of the knob lever 17 through an arc-shaped hole 112 of the second cover 11. The locking lever 16 has an arm 164 with a guide wall 165 that extends downward from a rotation center. The shaft 101 or the rotation center of the locking lever 16 is positioned above the striker-entering line X in the housing.

Figure 7:
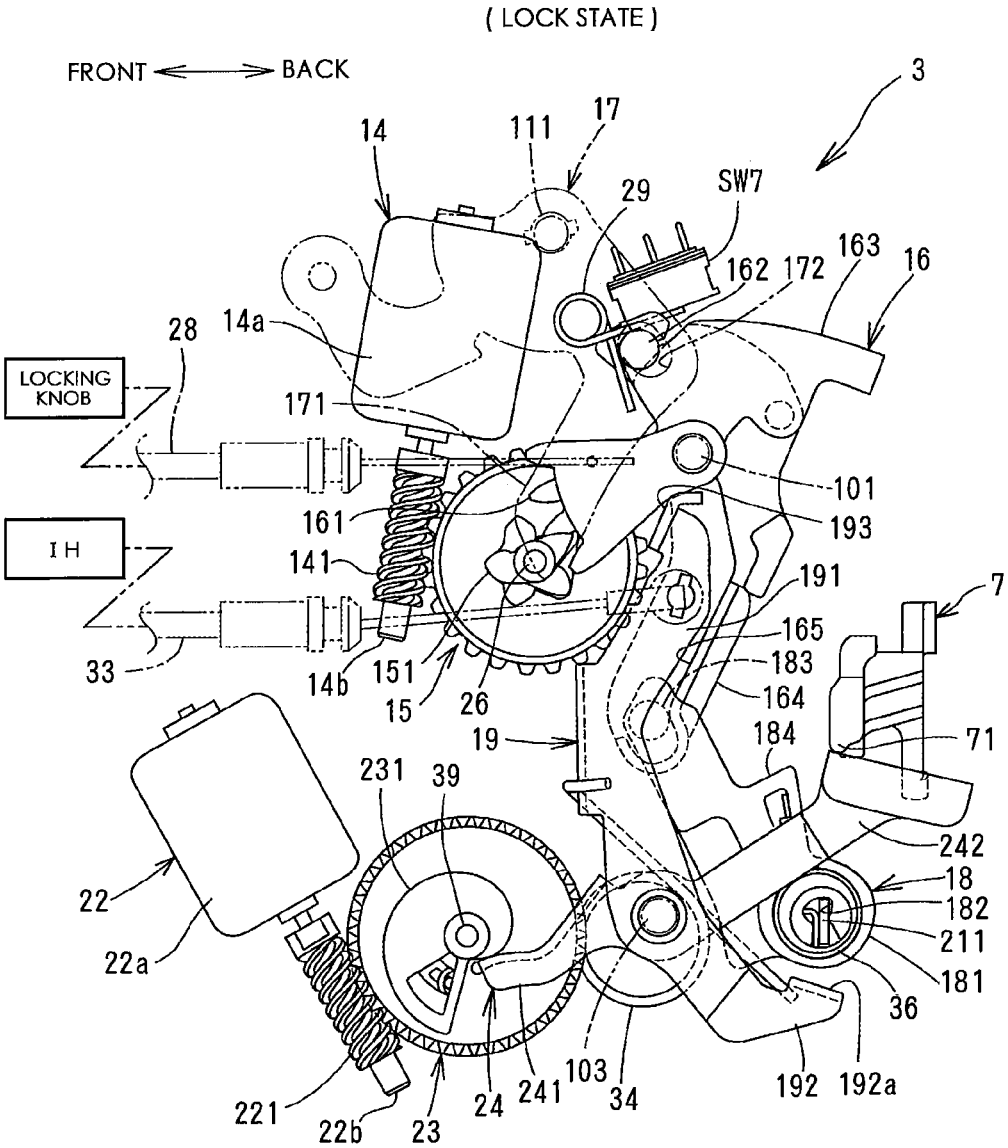
FIG. 7 is a side elevational view of the main part in a lock state.

Based on rotation of the key lever 20 with the key cylinder KC, rotation of the knob lever 17 with the locking knob and rotation of the locking worm wheel with the locking motor 14, the locking lever 16 can rotate to the unlock position in FIG. 6 and the lock position in FIG. 7 to which it rotates from the unlock position clockwise by a certain angle and is elastically held in the unlock and lock positions by an elastic force of the holding member 29. When the locking worm wheel 15 is in the neutral position, the teeth 161 of the locking lever 16 do not mesh with the teeth 151 of the locking worm wheel 15, so that the rotation of the locking lever 16 with the locking knob and the key cylinder KC is not transmitted to the locking worm wheel 15.

The holding member 29 that is a torsion spring has a coil supported a cylindrical support 102 (in FIG. 4) integrally formed with an inner side of the first cover 10; and two arms that surround the connecting projection 162 of the locking lever 16. Thus, in order to rotate the locking lever 16 from the unlock position (or the lock position) to the lock position (or the unlock position), a forcing direction is changed from an unlock direction (or a lock direction) to a lock direction (or an unlock direction) at an intermediate position between the unlock position and the lock position.

The locking lever 16 is stopped at the unlock position and the lock position by contacting a part of the locking lever with a rubber stopper (not shown) fixed on the inner side of the first cover 10.

On an upper outer circumferential surface of the locking lever 16, there is formed a cam surface 163 which contacts a detecting portion of a locking/unlocking detecting switch SW7 of the wiring member 25. With rotation of the locking lever 16, the detecting portion of the locking/unlocking detecting switch SW7 comes in sliding contact with the cam surface 163 to supply a signal corresponding to the unlock/lock state of the locking mechanism. The supplied signal is transmitted to ECU via the circuits on the wiring member 25.

The open link 18 has a drum-like connecting hole 182 at a lower rotary portion 181. A plate-like connecting portion 211 of the outside lever 21 is inserted into the connecting hole 182. Thus, the open link 18 is connected to the connecting portion 211 of the outside lever 21 to rotate by a certain angle longitudinally of the vehicle, and the upper connecting projection 183 is connected to the arm 164 of the locking lever 16 as described later. With movement of the locking lever 16 to the unlock position and the lock position, the open link 18 rotates to the unlock position (in FIG. 6) and the lock position (in FIG. 7) to which it rotates counterclockwise by a certain angle from the unlock position around the connecting portion 211 of the outside lever 21.

Furthermore, in the unlock position in FIG. 6, in the middle, the open link 18 has a releasing portion 184 which can contact the released portion 71 of the opening lever 7 from below. A torsion spring 36 is disposed at the rotary portion 181 of the open link 18.

One end of the torsion spring 36 engages with the open link 18, and the other end engages with the connecting portion 211 of the outside lever 21. Hence, the torsion spring 36 applies to the open link 18 an urging force in an unlock direction (clockwise in FIG. 6) around the connecting portion 211 of the outside lever 21 anytime. The urging force of the torsion spring 36 is set to be smaller than a force of the holding member 29 elastically holding the locking lever 16 in the lock position.

The connecting projection 183 of the open link 18 is connected to the arm 164 of the locking lever 16 such that it can slide vertically on the arm 164 of the locking lever 16 and can contact the guide wall 165 only at rotation of the locking lever 16 in the lock direction (counterclockwise in FIG. 6).

In the unlock state in FIG. 6, when the locking lever 16 rotates to the lock position, the open link 18 rotates from the unlock position to the lock position in FIG. 7 by contacting the guide wall 165 of the locking lever 16 with the connecting projection 183 of the open link 18. In the lock state in FIG. 7, when the locking lever 16 rotates to the unlock position, the open link 18 is rotated from the lock position to the unlock position in FIG. 6 with rotation of the locking lever 16 by the torsion spring 36 without depending on a contact relationship between the guide wall 165 and the connecting projection 183.

In the lock state in FIG. 7, the urging force of the torsion spring 36 exerts on the locking lever 16 in an unlocking direction (clockwise). The urging force of the torsion spring 36 is smaller than an elastic holding force for holding the locking lever 16 in a lock position with the holding member 29. So the locking lever 16 and the open link 18 are not rotated to the unlock position by the torsion spring 36.

The outside lever 21 is pivotally mounted to a front lower part of the body 4 via a shaft 31 that extends longitudinally of the vehicle to rotate vertically, and the connecting portion 211 is connected to the open link 18 as mentioned above. A connecting portion 212 is connected to the outside handle OH via a vertical connecting member (not shown). The outside lever 21 rotates by a certain angle against the spring (not shown) in a releasing direction (counterclockwise in FIG. 4), thereby releasing the open link 18 upward.

The releasing motor 22 is disposed in the housing. A case 22*a* (yoke) for the motor 22 is lower than the striker entering line X, and an output shaft 22*b* pivotally mounted to the case 22*a* is disposed downward and backward obliquely.

The releasing motor 22 is positioned below the striker entering line X. Rainwater which comes through the striker entering groove 41 is likely to be put on the releasing motor 22, which is positioned downward and backward obliquely, so rainwater into the case 22*a* can be held at the minimum.

The releasing worm wheel 23 is like a disc and is pivotally mounted in the housing via a shaft 39 that lies transversely of the vehicle. The releasing worm wheel 23 meshes with a worm 221 fixed to the output shaft 22*b* pivotally mounted to the case 22*a* of the releasing motor 22. The releasing worm wheel 23 is rotated by the releasing motor 22 against a spring 35 (in FIG. 4) wound on a shaft 39 clockwise from a set position (for example, in FIG. 6) by a certain angle to a position in FIG. 8, and returns to the set position from the position where it is rotated by the spring 35 when the releasing motor 22 stops. On the releasing worm wheel 23, there is a cam surface 231 with an involute curve in which a distance from an axis to an outer circumferential surface gradually increases counterclockwise in FIG. 6.

In the housing, the electric releasing lever 24 is pivotally mounted in the middle via a shaft 103 in the housing, and comprises a first arm 241 which extends forward such that an end can come in sliding contact with the cam surface 231 of the releasing worm wheel 23, and a second arm 242 which extends backward so that an end can come in contact with the released portion 71 of the opening lever 7 from below.

In FIG. 6, when the releasing worm wheel 23 is in the set position, the end of the first arm 241 of the electric release lever 24 comes in contact with a smaller-diameter portion of the cam surface 231, and the electric release lever 24 is thus held in a set position in FIG. 6. By the releasing motor 22, the releasing worm wheel 23 is rotated clockwise from the set position in FIG. 6 by a certain angle to the release position in FIG. 8. The end of the first arm 241 of the electric release lever 24 slides on the cam surface 231 to a larger-diameter portion of the cam surface 31. Hence, the electric release lever 24 rotates to a releasing position in FIG. 8, and the end of the second arm 242 comes in contact with the released portion 71 of the opening lever 7 from below. The opening lever 7 is released to disengage the latch 5 from the ratchet 6, and the front door FD can be opened.

In the housing, the inside lever 19 is pivotally mounted via the shaft 103 for the electric release lever 24, and comprises a first arm 191 that extends upward and projects outward through an arc-shaped opening 113 (in FIG. 3); a second arm 192 that extends downward and backward obliquely; and an unlocking portion 193 that can contact part 173 of the connecting arm 171 of the knob lever 17. An upper part of the first arm 191 is connected to the inside handle IH of the front door FD via a connecting member 33 comprising a Bowden cable, and the inside lever 19 is rotated by a certain angle counterclockwise from the set position in FIG. 6 against a spring 34 wound on the shaft 103 and released in FIG. 10.

At an end of the second arm 192, there is formed a contact portion 192*a* which can contact the rotary portion 181 of the open link 18 from below when the inside lever 19 is released.

The connecting member 33 is connected to an upper part of the first arm 191 of the inside lever 19 through between the case 14*a* for the locking motor 14 and the case 22*a* for the releasing motor 22 in the housing. Hence, transversely of the vehicle, the connecting member 33 does not overlap the cases 14*a*, 22*a* which are thick transversely of the vehicle, thereby reducing thickness of the housing transversely of the vehicle.

Figure 12:
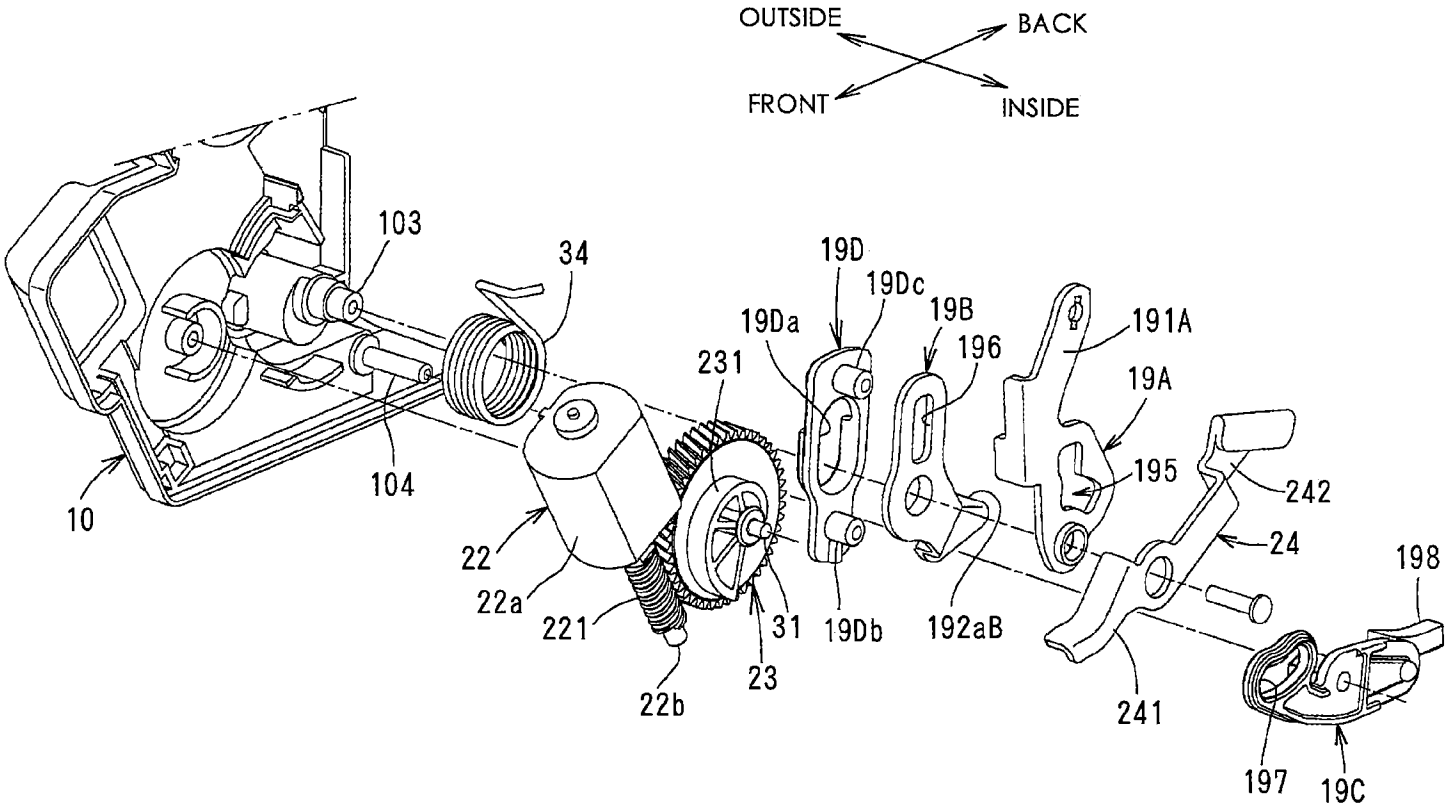
FIG. 12 is an exploded perspective view of the main part of the door lock device for a rear door.
Figure 13:
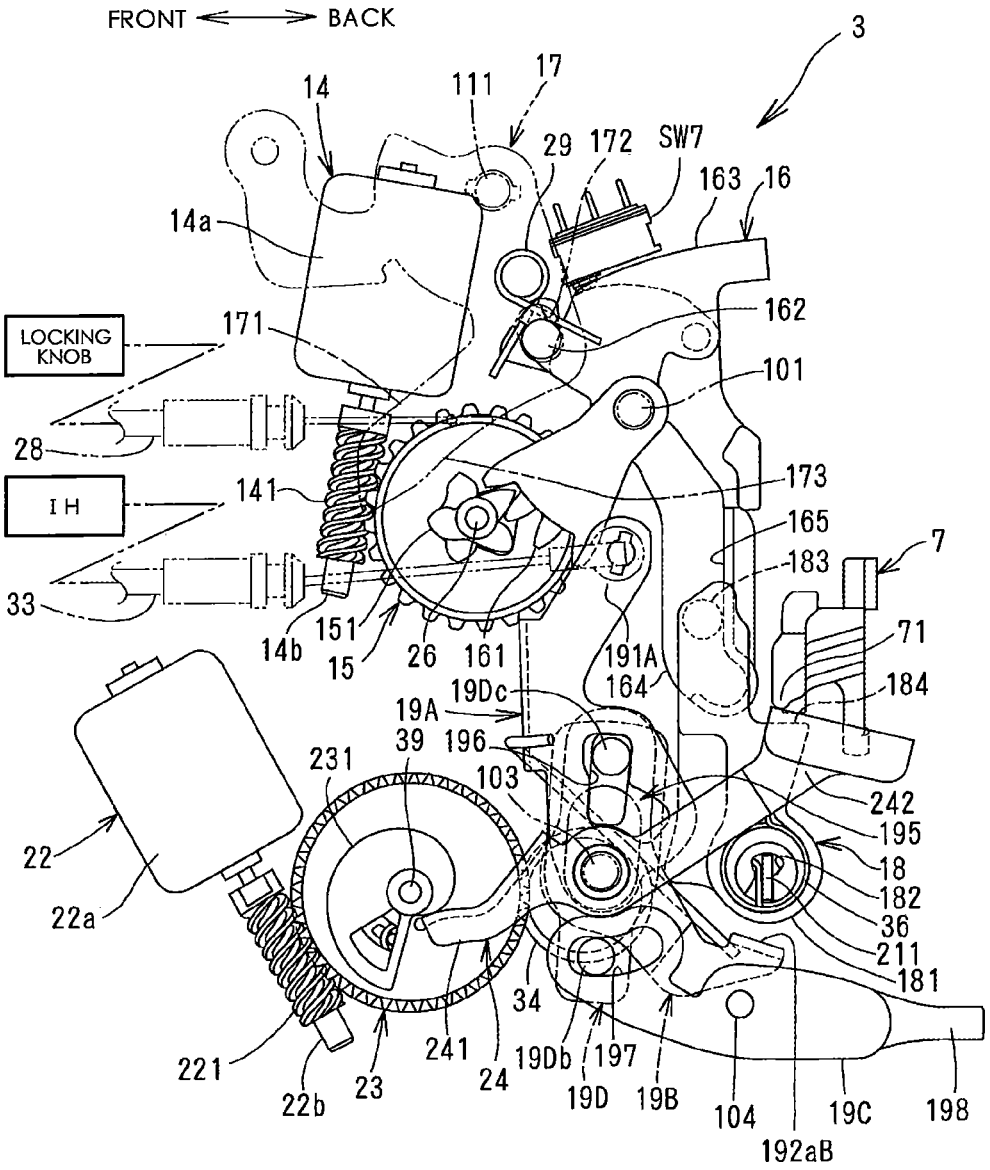
FIG. 13 is a side elevational view of the main part when the locking mechanism is in an unlock state and a childproof mechanism is in a childproof unlock state.
Figure 14:
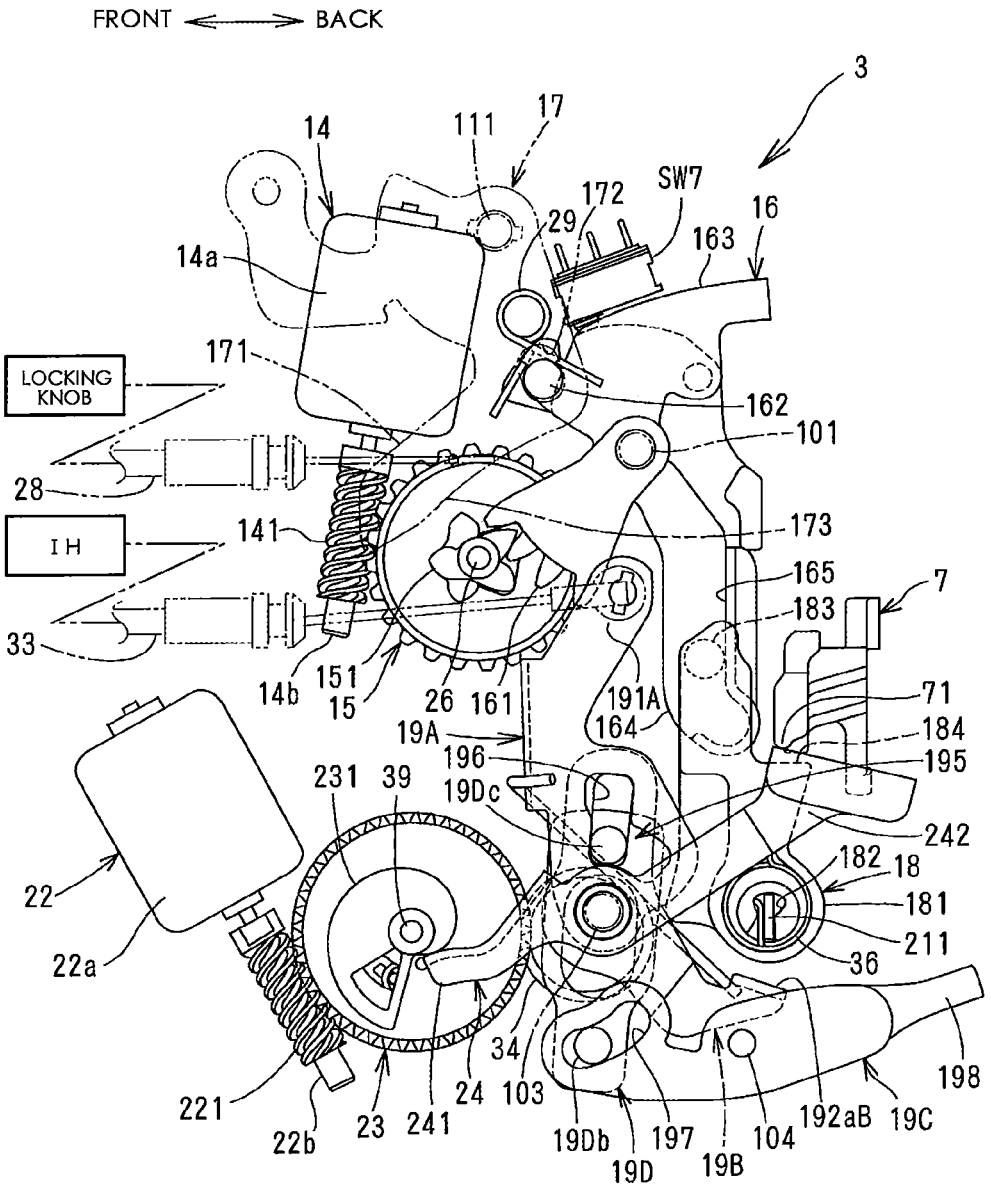
FIG. 14 is a side elevational view of the main part when the locking mechanism is in the unlock state and the childproof mechanism is in a childproof lock state.

In FIGS. 12 to 14, a door lock device 1R for a rear door RD will be described.

The door lock device 1R comprises an engagement unit 2 (not shown) which is the same as the engagement unit 2 of the door lock device 1F, and an operating unit 3 that is partially different from the operating unit 3 for the door lock device 1F. The door lock device 1R will be described only on differences from the door lock device 1F.

Instead of the inside lever 19 in the door lock device 1F, the door lock device 1R comprises a first inside lever 19A, a second inside lever 19B, a childproof lever 19C of a childproof mechanism and a connect link 19D.

The first and second inside levers 19A, 19B are supported on the shaft 103 for an electric release lever 24.

In the first inside lever 19A, an upper end of a first arm 191A extending upward is connected to the inside handle IH of the rear door RD via the connecting member 33. The inside lever 19A is released counterclockwise from a set position in FIG. 13 according to a door-opening action of the inside handle IH. An L-shaped control hole 195 is formed in the first inside lever 19A.

The second inside lever 19B has a vertically elongate hole 196 which partially overlaps the control hole 195 of the first inside lever 19A; and a contact portion 192*a*B.

The childproof lever 19C is pivotally mounted in the housing via a shaft 104, and can rotate between a childproof unlock position in FIG. 13 and a childproof lock position in FIG. 14 to which it rotates counterclockwise by a certain angle from the childproof unlock position. The childproof lever 19C has an arc-shaped hole 197 formed longitudinally of the vehicle at a front part, and an operating portion 198 which projects from a rear end of the rear door RD, at a rear part.

A vertically elongate hole 19Da in the middle of the connect link 19D engages on the shaft 103 to slide vertically. A lower projection 19Db at a lower part slides in an arc-shaped hole 197 of the childproof lever 19C, and an upper projection 19Dc slides in the control hole 195 and the elongate hole 196. Hence, when the childproof lever 19C is in the childproof unlock position in FIG. 12, the upper projection 19Dc engages in an upper narrower part of the control hole 195 to enable releasing of the first inside lever 19A to transmit to the second inside lever 19B, and when the childproof lever 19C is in the childproof lock position in FIG. 13, the upper projection 19Dc is positioned in a lower wider part of the control hole 195 not to enable releasing of the first inside lever 19A to be transmitted to the second inside lever 19B.

An electric circuit with ECU in this embodiment will be described.

Figure 15:
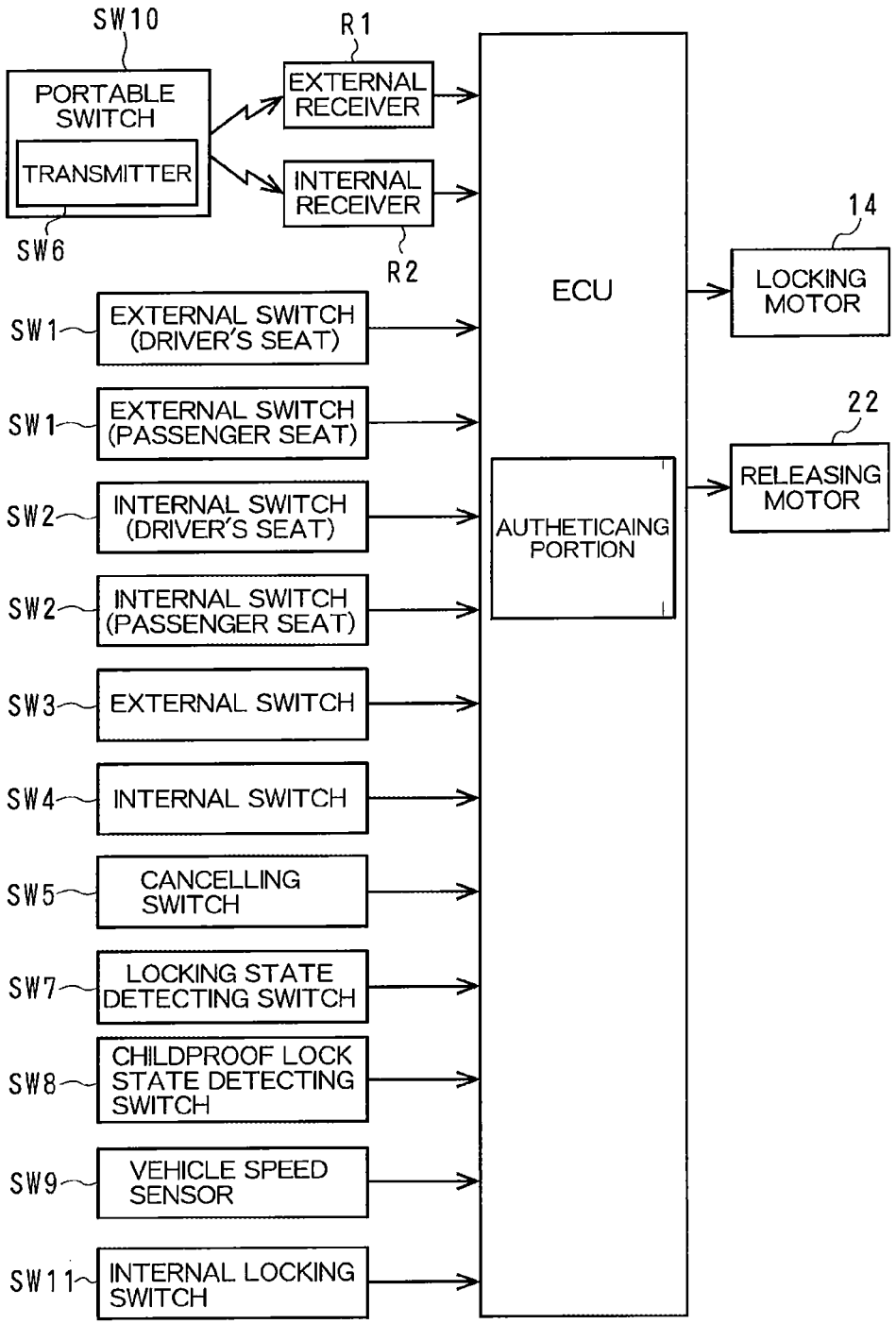
FIG. 15 is a block diagram showing a control circuit.

In FIG. 15, ECU comprises a one-chip CPU comprising a ROM that stores a control program and a RAM that functions as a working area for CPU, and carries out a series of control processing based on the control program stored in ROM. ECU comprises an authenticating portion for checking an ID signal of a wireless communication conducted between a transmitter SW6 and each of receivers R1, R2. The authenticating portion may separately be disposed from ECU.

Input ports of ECU are electrically connected to each of the receivers R1, R2; external switches SW1, SW2 for each of the doors; internal switches SW2, SW4 for each of the doors; the cancelling switch SW5; a locking-state detecting switch SW7; a childproof-lock detecting switch SW8 for detecting each state of the childproof mechanism; a vehicle speed sensor SW9 for detecting vehicle speed; and an internal locking switch SW11, and each signal is fed into ECU. To output ports are connected the locking motor 14 and the releasing motor 22.

The cancelling switch SW5 is operated to switch between an unset state for enabling operation of the internal switches SW2, SW4 on the doors except the front door at driver's seat, and a cancelling state for cancelling the operation. ECU receives an unset signal from the cancelling switch SW5 to keep the unset state for enabling the operation of the internal switches SW2, SW4 and receives a cancelling signal from the cancelling switch SW5 to hold a canceling state for cancelling the operation the internal switches SW2, SW4.

The locking state detecting switch SW7 that detects a state of the locking mechanism detects an unlock state to transmit an unlock signal to ECU and detects a lock state to transmit a lock signal to ECU respectively.

The childproof-lock-state detecting switch SW8 that detects a state of the childproof mechanism detects a childproof unlock state to transmit a childproof unlock signal, and detects a childproof lock state to transmit a childproof lock signal to ECU respectively.

The vehicle speed sensor SW9 that detects a stop and a run of the vehicle detects the stop or a speed less than a predetermined speed to transmit a stop signal to ECU and detects a speed over the predetermined speed to transmit a running signal to ECU respectively.

The internal locking switch SW11 inside the vehicle transmits an unlock signal to ECU with unlocking, and a lock signal with locking to ECU respectively. When ECU receives the unlock signal, it carries out an unlocking control to the locking motor 14 to turn the locking mechanism to an unlock state, and when ECU receives a lock signal, it carries out locking control to the locking motor 14 to turn the locking mechanism to a lock state.

ECU receives each signal from the transmitter SW6, the cancelling switch SW5, the locking-state detecting switch SW7, the childproof lock state detecting switch SW8 and the vehicle speed sensor SW9. Depending on receiving situation, ECU carries out turning control for enabling and cancelling a door-opening action of the switches SW1 to SW4 and the portable switch SW10, and receives a door-opening signal from the enabled switches SW1 to SW4 and the portable switch SW10 to carry out a releasing control to the releasing motor 22 for the door.

Turning control of ECU is shown in FIG. 16 for the front door FD, and in FIG. 17 for the rear door RD.

In the column for "transmitter SW6" in FIGS. 16 and 17, "authenticated" (outside vehicle)" means that it authenticates an ID signal between "external receiver R1" and "transmitter SW 6" when a user with the transmitter SW6 is within a predetermined area outside the vehicle, and "unauthenticated" means that the transmitter does not authenticate an ID signal from the transmitter SW6 when it does not exist within a predetermined area outside the vehicle and within an interior of the vehicle, and "authenticated (inside vehicle)" means that it authenticates an ID signal between the internal receiver R2 and the transmitter SW6 when the transmitter SW6 is inside the vehicle or a user is inside the vehicle.

With respect to FIGS. 16 and 17, ECU carries out turning control as below.

<Front Door FD>

In FIG. 16, in "AUTHENTICATED (OUTSIDE THE VEHICLE)" of the transmitter SW6, when the vehicle speed sensor SW9 detects a stop of the vehicle V, the external switches SW1 on the door at the driver's seat and the door at the passenger seat are enabled to operate regardless of a detected state of the cancelling switch SW5 and locking-state detecting switch SW7.

In a cancelling state cancelled by the cancelling switch SW5, the internal switch SW2 on the passenger door is not enabled to operate even when a stop signal is supplied from the vehicle speed sensor SW9.

In "NOT AUTHENTICATED" state of the transmitter SW6, the internal switches SW2 on the door at the driver's seat and the door at the passenger seat are enabled to operate when the vehicle speed sensor SW9 supplies a stop signal. Except this operation, all is cancelled.

In "AUTHENTICTED (INSIDE)" state of the transmitter SW6, the external switches SW1 on the door at the driver's seat and the door at the passenger seat are enabled to operate when the locking-state detecting switch SW7 detects an unlock state, but when it detects a lock state, they are cancelled. Thus, the door is unlikely to be opened unexpectedly by a person outside the vehicle when a user is inside the vehicle.

<Rear Door>

In a "AUTHENTICATED (OUTSIDE)" for the transmitter SW6" in FIG. 17, the external switch SW3 and portable switch SW10 are enabled to operate regardless of a detected state of the locking-state detecting switch SW7 and childproof-lock-state detecting switch SW8 when the vehicle speed sensor SW9 supplies a stop signal.

When the childproof-lock-state detecting switch SW8 detects a childproof lock state, the internal switch SW4 is cancelled regardless of a detected state of the locking-state-detecting switch SW7 and vehicle speed sensor SW9. Thus, the internal switch SW4 is prevented from being operated by a child in error.

In "UNAUTHENTICATED" state of the transmitter SW6, when unset state is held by the cancelling switch SW5, the internal switch SW4 is enabled to operate only when the vehicle speed sensor SW9 supplies a stop signal. Except it, all is cancelled. Thus, even if a regular user is out of the vehicle, the passenger can open the rear door swiftly with the internal switch SW2.

In "AUTHENTICATED (INSIDE)" of the transmitter SW6, the external switch SW3 is enabled to operate when the locking-state detecting switch SW7 detects an unlock state, but is cancelled when it detects a lock state. Hence, the door is unlikely to be opened unexpectedly by a person outside the vehicle.

Main action of the door lock devices 1F, 1R will be described.

The following states are premised on the basis that each of the doors is closed, ECU authenticates an ID signal from the transmitter SW6, the vehicle sensor SW9 supplies a stop signal, an unset state is held by the cancelling switch SW5, and the switches SW1 to SW4 are all enabled.

When the front door FD acts like the rear door RD, the front door FD will be described only.

<When the Locking Mechanism is in an Unlock State and the Door is Tried with the Outside Handle OH (for the Front Door FD and the Rear Door RD)>

The door is tried with the outside handle OH in an unlock state of the locking mechanism in FIG. 6, and a door-opening action is transmitted to the outside lever 21 via a connecting member (not shown), and the outside lever 21 is released. The open link 18 connected to the connecting portion 211 of the outside lever 21 is released upward from the set position in FIG. 6, and the releasing portion 184 comes in contact with the released portion 71 of the opening lever 7 from below. The opening lever 7 is released. Thus, the ratchet 6 disengages from the full-latch engagement portion 51 of the latch 5, and the front door FD can be opened. Each of the doors can be opened with the outside handle OH regardless of enabling or cancelling of the external switches SW1, SW3 when the locking mechanism is in an unlock state.

<When the Locking Mechanism is in an Unlock State and the Inside Handle IH is Operated (for the Front Door FD and the Rear Door RD)>

Figure 10:
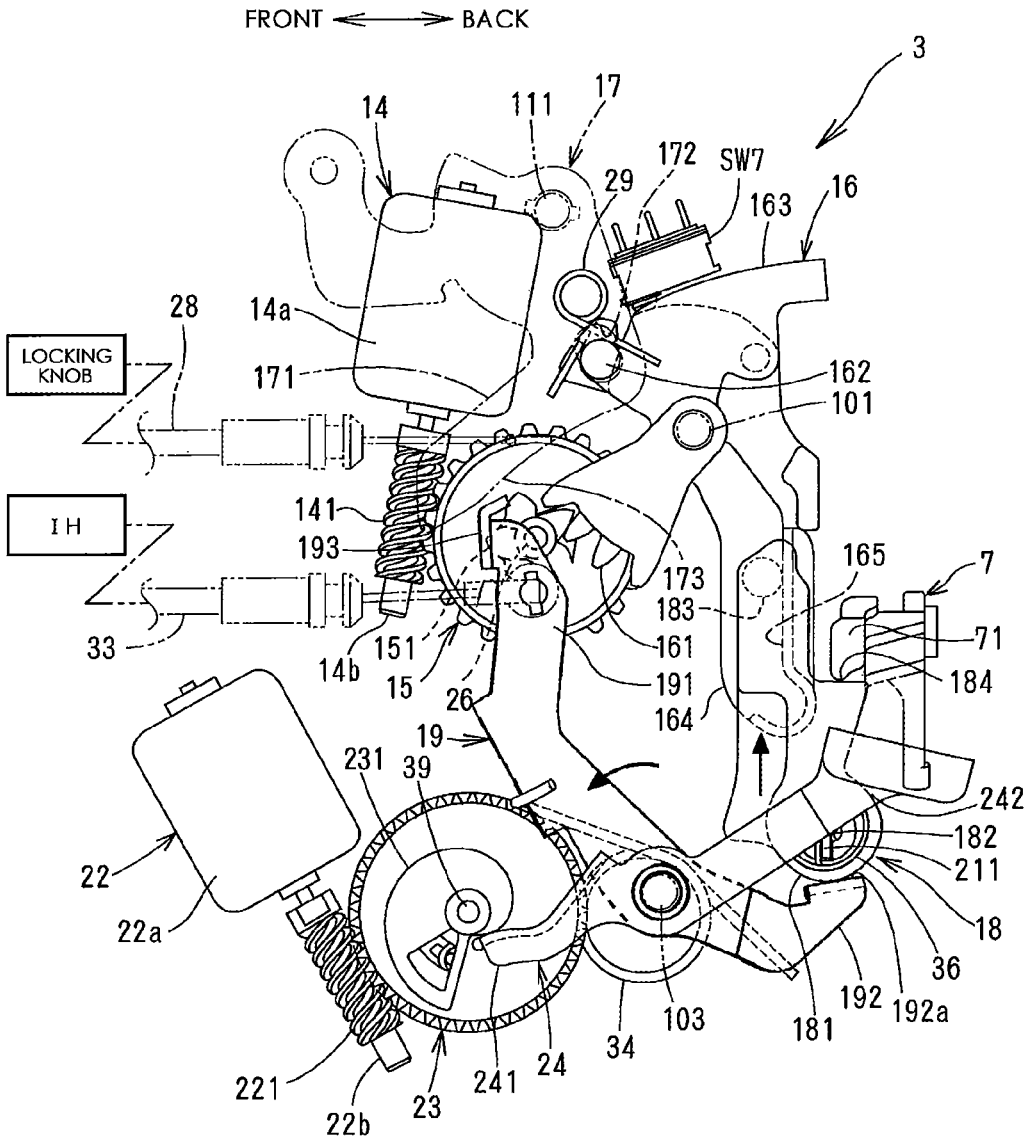
FIG. 10 is a side elevational view of the main part that is manually released in the unlock state.

The door is tried with the inside handle IH in an unlock state of the locking mechanism in FIG. 6, and a door-opening action is transmitted to the inside lever 19 via the connecting member 33. The inside lever 19 is released to rotate counterclockwise by a certain angle around the shaft 103 for the electric release lever 24. In FIG. 10, the contact portion 192*a* of the first arm 192 comes in contact with the rotary portion 181 of the open link 18 thereby releasing the open link 18 upward. The open link 18 is released, and the releasing portion 184 comes in contact with the released portion 71 of the opening lever 7 from below. The opening lever 7 is rotated thereby releasing the engagement mechanism, and the front door FD can be opened.

<When the Locking Mechanism is in a Lock State and the Outside Handle OH is Operated (for the Front Door FD and the Rear Door RD)>

The door is tried with the outside handle OH in a lock state in FIG. 7, and the action is transmitted to the outside lever 21. The open link 18 is released upward from the set position in FIG. 7. But the releasing portion 71 of the opening lever 7 swings in front of the released portion 71 without contacting to the released portion 91, and the opening lever 7 is not released. The front door FD cannot be opened.

<When the Locking Mechanism is in a Lock State and the Inside Handle IH is Operated (for the Front Door FD)>

Figure 11:
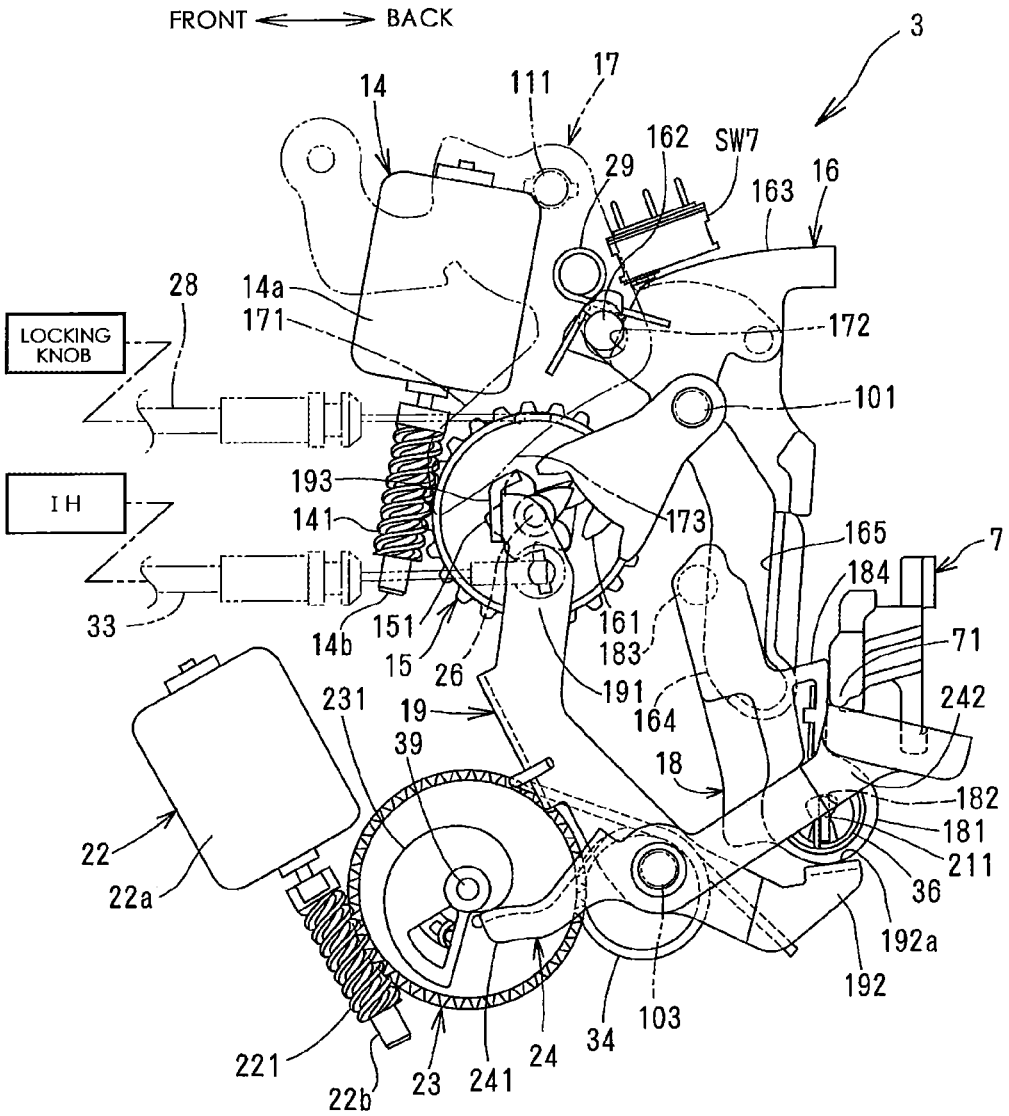
FIG. 11 is a side elevational view of the main part that is manually released in the lock state.

The door is tried with the inside handle IH in the lock state in FIG. 7, and the inside lever 19 is released counterclockwise in FIG. 7 against the spring 34 from the set position in FIG. 7. In FIG. 11, the unlocking portion 193 of the inside lever 19 comes in contact with the part 173 of the knob lever 17, thereby moving the locking lever 16 and the open link 18 from the lock position to the unlock position.

With releasing of the inside lever 19, the open link 18 moves upward in front of the released portion 71 of the opening lever 7 without contacting to the released portion 71 and rotates with the locking lever 16 in an unlocking direction. In FIG. 11, part of the open link 18 comes in contact with part of the opening lever 7 from a direction where the opening lever 7 cannot rotate, and the open link 18 stops once just before the unlock position. The inside handle IH is returned to a non-operating position once, and the open link 18 moves downward. The part of the open link 18 leaves the part of the open lever 7, and the open link 18 moves to the unlock position with the torsion spring 36. Thus, the locking mechanism is completely shifted to the unlock state. Thereafter, the door is opened with the inside handle again, the engagement mechanism is released, and the front door FD can be opened.

<When the Locking Mechanism is in the Unlock State and the Childproof Mechanism is in a Childproof Unlock State (for the Rear Door RD)>

"Childproof unlock state" means that the childproof operating lever 19C is in a childproof unlock position to enable an action of the first inside lever 19A to be transmitted to the second inside lever 19B, and "childproof lock state" means that the childproof operating lever 19C is in a childproof lock position not to enable an action of the first inside lever 19A to be transmitted to the second inside lever 19B.

In FIG. 13, the door is tried with the inside handle IH, and the first inside lever 19A rotates counterclockwise by a certain angle from the set position around the shaft 103. The rotation is transmitted via the connect link 19D to the second inside lever 19B, which is released counterclockwise with the first inside lever 19A. Thus, the contact portion 192*a*B of the second inside lever 19B comes in contact with a lower part of the rotary portion 181 of the open link 18 from below, and the open link 18 is released upward. The releasing portion 184 of the open link 18 comes in contact with the released portion 71 of the opening lever 7 from below to make the opening lever 7 rotate in a releasing direction, thereby releasing the engagement mechanism and enabling the rear door RD to open.

<When the Locking Mechanism is in the Unlock State and the Childproof Mechanism is in the Childproof Lock State (for the Rear Door RD)>

On the basis of a door-opening action of the inside handle IH in FIG. 14, the first inside lever 19A is released, but the releasing action is not transmitted to the second inside lever 19B. The rear door RD cannot be opened. The rear door RD can be opened with the outside handle OH, but cannot be opened with the inside handle IH.

<When the Locking Mechanism is in the Unlock or Lock State, Open-Switch Portion of the External Switches SW1, SW3 or Portable Switch SW10 is Operated (for the Front Door FD or Rear Door RD)>

ECU receives a door-opening signal from any one of the external switches SW1, SW3 and portable switch SW10. In order to rotate the releasing worm wheel 23 of the opening door (door operated with the external switches SW1, SW3 or a door selected with the portable switch SW10) in a releasing direction (for example, clockwise in FIG. 6), the releasing motor 22 is controlled for releasing. Regardless of a state of the locking mechanism, the electric release lever 24 rotates from the set position to a releasing position (FIG. 8 in an unlock state and FIG. 9 in a lock state) with rotation of the releasing worm wheel 23 in a releasing direction with sliding of the end of the first arm 241 along the cam surface 231 of the releasing worm wheel 23. The end of the second arm 242 comes in contact with the released portion 71 of the opening lever 7 from below to make the opening lever 7 released. Thus, the engagement mechanism is released, and the opening door can be opened.

In this motion, the electric release lever 24 directly releases the opening lever 7 regardless of a state of the locking mechanism (including the childproof mechanism in the rear door RD). Thus, even when the locking mechanism is in a lock state, the opening door can be opened swiftly by the releasing motor 22 with a single door opening action of the external switches SW1, SW3 or portable switch SW10.

<When the Internal Switch SW2 or SW4 is Operated in an Unlock or Lock State of the Locking Mechanism (for the Front Door FD and Rear Door RD)>

When ECU receives a door-opening signal from the internal switch SW2 or SW4, ECU drives the releasing motor 22 for the opening door for releasing. Regardless of a state of the locking mechanism (including the childproof mechanism in the rear door RD), the electric release lever 24 is released, and the opening door can be opened with a single door-opening action of the internal switch SW2 or SW4.

<When a Door-Opening Action of the External Switch SW1, SW3 or Portable Switch SW10 is Carried Out Substantially Together with an Unlocking Action of the Internal Locking Switch SW11 in a Lock State of the Locking Mechanism>

ECU receives a door-opening signal from any one of the external switch SW1, SW3 and portable switch SW10. Thus, the releasing motor 22 for the opening door is driven for releasing. ECU receives an unlocking signal from the internal locking switch SW11 thereby unlocking the locking motor 14.

Figure 8:
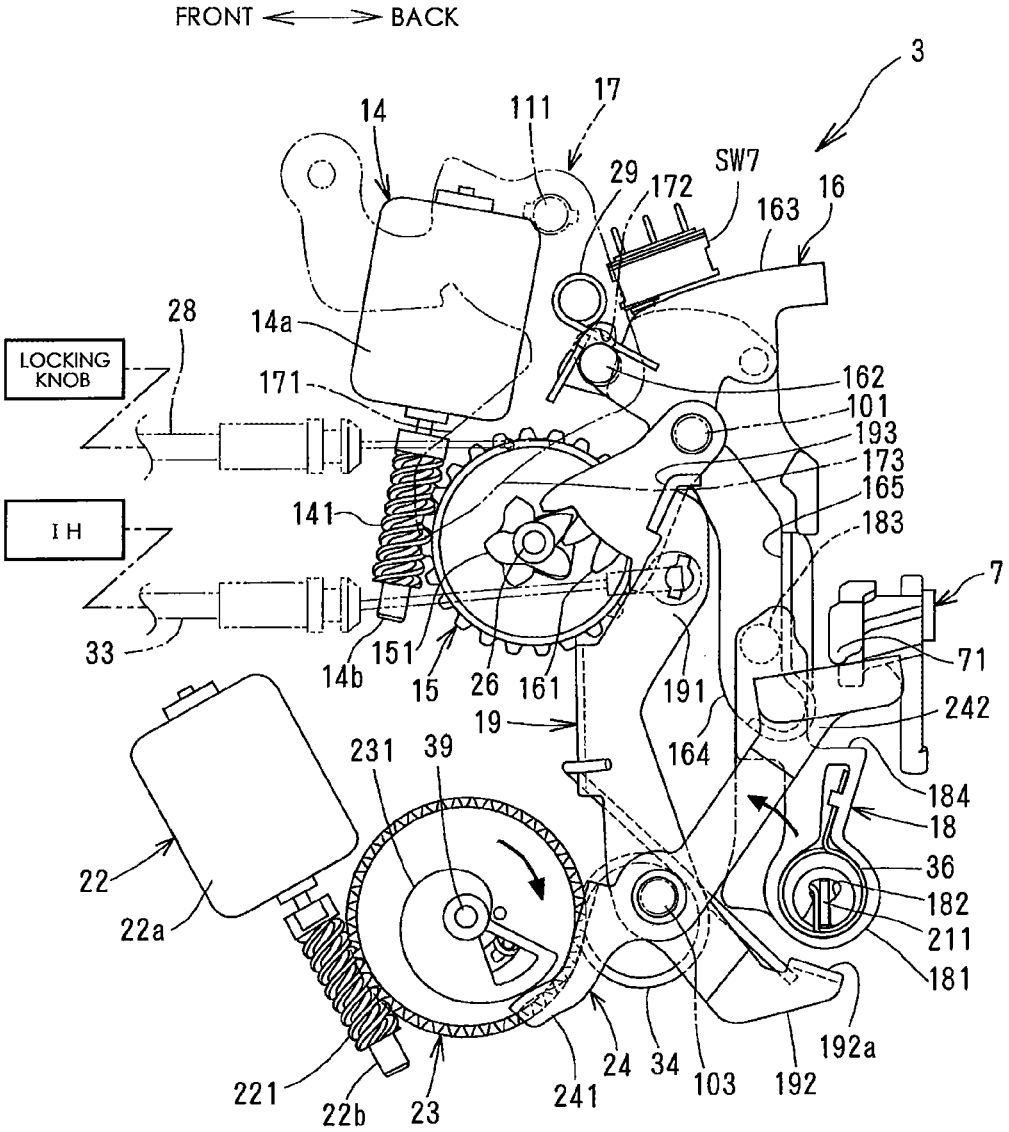
FIG. 8 is a side elevational view of the main part that is electrically released in the unlock state.
Figure 9:
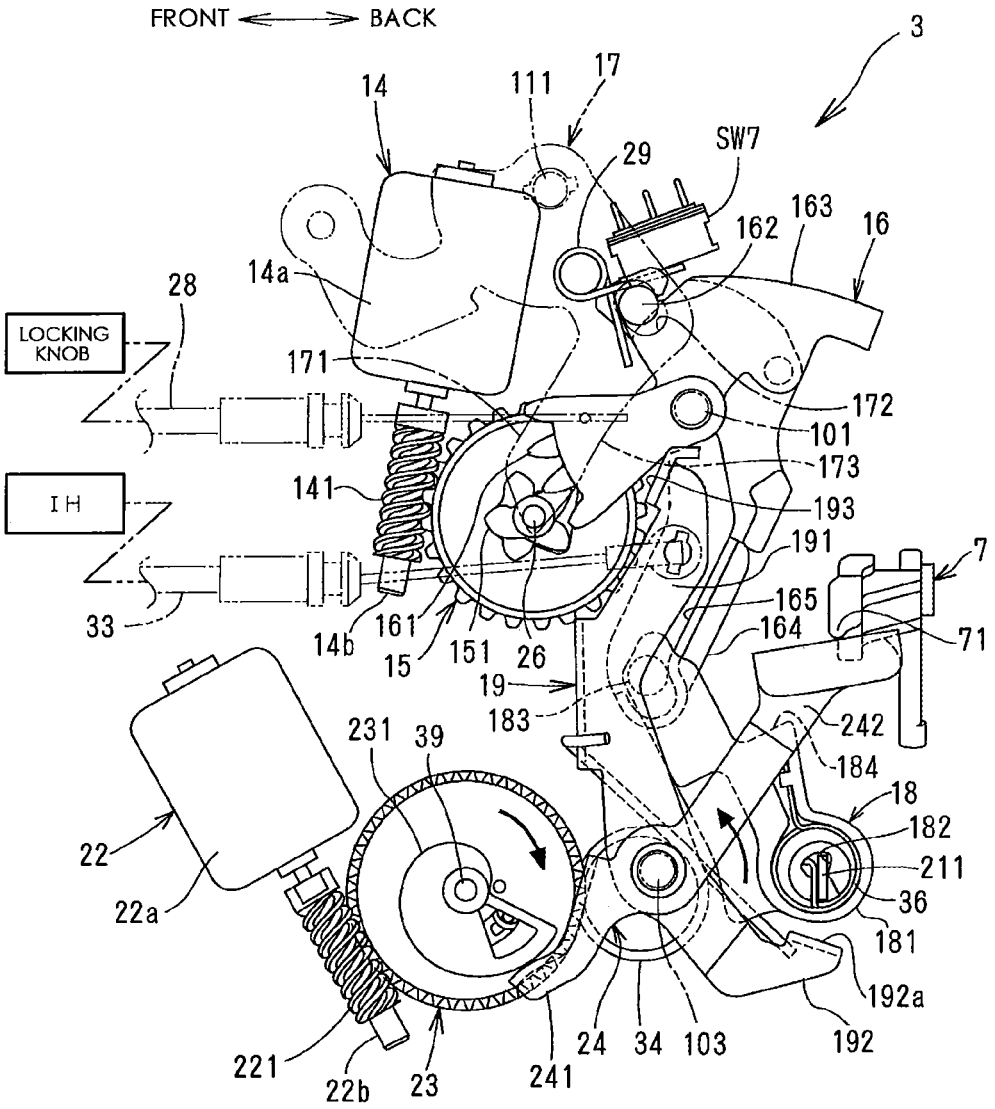
FIG. 9 is a side elevational view of the main part that is electrically released in the lock state.

So, the electric release lever 24 is released from the set position in FIG. 8 regardless of the state of the locking mechanism. Meanwhile, substantially together with releasing of the electric release lever 24, the locking mechanism turns from the lock state in FIG. 7 to the unlock state by driving the locking motor 14. As a result, in FIG. 8, the electric release lever 24 directly releases the opening lever 7, while the locking mechanism turns from the lock state to the unlock state without contacting the opening lever 7. Even if releasing of the electric release lever 14 is performed together with turning of the locking mechanism from the lock state to the unlock state, a panic phenomenon in which part of the open link 18 of the locking mechanism comes in contact with the opening lever 7 from a direction where the opening lever 7 cannot be rotated to stop the open link 18 once just before the unlock position does not occur. Thus, the door can be opened swiftly with a single door-opening action of the external switch SW1, SW3 or portable switch SW10, and the locking mechanism can be switched to the unlock state securely.

One embodiment of the present invention is described as above, and various modifications and changes or their combination may be made to the embodiments without departing from the scope of the invention.

(1) The door is a sliding door supported on the side of the vehicle to open and close longitudinally of the vehicle.

(2) The door is electrically opened and closed by a door opening device with a motor as a drive source. The door opening device is controlled to open the door after releasing the engagement mechanism with a door-opening action of electric operating elements.

(3) In order to open a door in which a locking mechanism is locked by releasing the releasing motor 22, the locking motor 14 is controlled for unlocking to turn the locking mechanism from a lock state to an unlock state just after releasing of the releasing motor 22, after a predetermined time passes from finishing of releasing or when the open door is closed.

(4) Even when the authenticating portion does not authenticate an ID signal, a door can be opened by enabling a door opening of the external switches SW1, SW3 for the door in an unlock state.

What is claimed is:

1. A motor vehicle door lock device comprising:

an engagement mechanism, positioned within a casing, that engages with a striker to hold a door closed;

an external mechanically-operating element that is located on an outside of the door of a motor vehicle, the external mechanically-operating element operative for opening the door;

an external electrically-operating element that is located on the outside of the door, the external electrically-operating element operative for detecting a touch of a finger of a user or approach of a part of a human body, the external electrically-operating element and the external mechanically-operating element being independently operable from each other;

an internal mechanically-operating element that is located on an inside of the door, the internal mechanically-operating element operative for opening the door;

an internal electrically-operating element that is located on the inside of the door, the internal electrically-operating element operative for detecting a touch of a finger of the user or approach of the part of a human body;

a locking mechanism that comprises mechanical elements and turns between an unlock state that enables the engagement mechanism to be released with a door-opening action of the external mechanically-operating elements by a locking motor as a drive source and a lock state that does not enable the engagement mechanism to be released;

a control with which the external electrically-operating element and the internal electrically-operating element are connected, and which can authenticate a transmitter used exclusively for the motor vehicle, wherein the control enables an operation of the external electrically-operating element when with the transmitter located outside of the motor vehicle, the transmitter is authenticated by the control and wherein the control cancels the operation of the external electrically-operating element when the transmitter is located outside of the motor vehicle and the transmitter is not authenticated by the control; and an electric release mechanism that comprises a releasing motor connected with the control and operative to enable the engagement mechanism to be released by driving the releasing motor as a drive source, wherein when the control authenticates that the transmitter exists within a predetermined area outside the motor vehicle, the electric release mechanism enables the engagement mechanism to be released by releasing the releasing motor based on a single operation of the external electrically-operating element operating independently from the external mechanically-operating element regardless of a state of the locking mechanism, wherein when the control authenticates that the transmitter exists within an interior of the motor vehicle, the electric release mechanism enables the engagement mechanism to be released by releasing the releasing motor based on a single operation of the internal electrically-operating element operating independently from the internal mechanically-operating element regardless of the state of the locking mechanism, wherein the engagement mechanism comprises an opening lever that rotates and releases the engagement mechanism from the striker, wherein the electric release mechanism further comprises an electric release lever, pivotally mounted to the casing, rotated by the releasing motor to directly contact and release the opening lever, and wherein when a turning action of the locking mechanism from the lock state to the unlock state by the locking motor is performed substantially together with a releasing action of the releasing motor based on an operation of the external electrically-operating element, the electric release mechanism drives the electric release lever by the releasing motor so that the electric release lever directly contacts and releases the opening lever and the locking mechanism shifts to the unlock state without contacting the opening lever.

2. The motor vehicle door lock device of claim 1, wherein when the locking mechanism is in the unlock state, the opening lever can be released by a door-opening action of the external electrically-operating element to release the engagement mechanism without operation of the operating unit.

3. The motor vehicle door lock device of claim 1, further comprising a childproof mechanism that comprises mechanical elements and can turn to a childproof lock state that cancels an operation of the internal mechanically-operating element regardless of a state of the locking mechanism, wherein the control cancels the operation of the internal electrically-operating element if the childproof mechanism is in the childproof lock state.

4. The motor vehicle door lock device of claim 3, further comprising a canceling switch that is operated at a driver's seat and is electrically connected with the control, wherein all doors are respectively provided with the internal electrically-operating element, wherein the control cancels the operation of the internal electrically-operating element on each door except a door at the driver's seat based on that the control receives a canceling signal from the canceling switch, wherein the doors except the door at the driver's seat comprise at least one door provided with the childproof mechanism, wherein the motor vehicle door lock device further comprises a childproof-lock detecting switch that detects a childproof unlock state and a childproof lock state of the childproof mechanism and is electrically connected with the control, and wherein the control cancels the operation of the internal electrically-operating element on said at least one door provided with the childproof mechanism based on that the control receives the canceling signal from the canceling switch, regardless of whether the childproof-lock detecting switch detects the childproof unlock state or the childproof lock state of the childproof mechanism.

5. The motor vehicle door lock device claim 4 wherein the control performs unlocking drive control to the locking motor to turn the locking mechanism to the unlock state when the locking mechanism is in the lock state and the releasing motor is released.

6. The motor vehicle door lock device of claim 4 wherein the control cancels the operation of the internal electrically-operating element when a vehicle speed sensor detects a run.

7. The motor vehicle door lock device claim 6 wherein the control performs unlocking drive control to the locking motor to turn the locking mechanism to the unlock state when the locking mechanism is in the lock state and the releasing motor is released.

8. The motor vehicle door lock device of claim 3 wherein the control cancels the operation of the internal electrically-operating element when a vehicle speed sensor detects a run.

9. The motor vehicle door lock device claim 8 wherein the control performs unlocking drive control to the locking motor to turn the locking mechanism to the unlock state when the locking mechanism is in the lock state and the releasing motor is released.

10. The motor vehicle door lock device claim 3 wherein the control performs unlocking drive control to the locking motor to turn the locking mechanism to the unlock state when the locking mechanism is in the lock state and the releasing motor is released.

11. The motor vehicle door lock device of claim 1, further comprising a canceling switch that is operated at a driver's seat and is electrically connected with the control, wherein all doors are respectively provided with the internal electrically-operating element, and wherein the control cancels the operation of the internal electrically-operating element on each door except a door at the driver's seat based on that the control receives a canceling signal from the canceling switch.

12. The motor vehicle door lock device of claim 11 wherein the control cancels the operation of the internal electrically-operating element when a vehicle speed sensor detects a run.

13. The motor vehicle door lock device claim 12 wherein the control performs unlocking drive control to the locking motor to turn the locking mechanism to the unlock state when the locking mechanism is in the lock state and the releasing motor is released.

14. The motor vehicle door lock device claim 11 wherein the control performs unlocking drive control to the locking motor to turn the locking mechanism to the unlock state when the locking mechanism is in the lock state and the releasing motor is released.

15. The motor vehicle door lock device of claim 1 wherein the control cancels the operation of the internal electrically-operating element when a vehicle speed sensor detects a run.

16. The motor vehicle door lock device claim 15 wherein the control performs unlocking drive control to the locking motor to turn the locking mechanism to the unlock state when the locking mechanism is in the lock state and the releasing motor is released.

17. The motor vehicle door lock device of claim 1 wherein the control performs unlocking drive control to the locking motor to turn the locking mechanism to the unlock state when the locking mechanism is in the lock state and the releasing motor is released.

18. The motor vehicle door lock device claim 1, wherein an inside lever pivotally mounted to a shaft that is common to the electric release lever and the inside lever and supports each of the levers independently, the inside lever rotating based on a door-opening action of the internal mechanically-operating element to release the opening lever.

* * * * *